US005212816A

United States Patent [19]

Gimenez et al.

[11] Patent Number: 5,212,816

[45] Date of Patent: May 18, 1993

[54] HORN HONKER INTERFACE

[76] Inventors: Oscar Gimenez, 72-21 60th Ave., Maspeth, N.Y. 11378; George Spector, 233 Broadway RM 3815, New York, N.Y. 10007

[21] Appl. No.: 577,445

[22] Filed: Sep. 4, 1990

[51] Int. Cl.[5] ..... G08B 3/00

[52] U.S. Cl. ..... 455/156.1; 340/311.1; 340/384 R; 455/345

[58] Field of Search ..... 455/149, 152, 155, 156, 455/159, 345, 78, 54, 38; 340/311.1, 428, 404–406, 384 R, 384 E, 393, 815.22, 902, 904, 825–844

[56] References Cited

U.S. PATENT DOCUMENTS 4,162,479 7/1979 Nickell et al. ..... 340/63

4,383,249 5/1983 Frigo ..... 340/384 R 4,866,415 9/1989 Obayashi et al. ..... 340/384 E 4,962,528 10/1990 Herrera ..... 379/442

*Primary Examiner*—Reinhard J. Eisenzopf

*Assistant Examiner*—Chi H. Pham

[57] ABSTRACT

An audible interface device for each of a plurality of mobile units equipped with a radio dispatch system operated by a computer is provided. The device consists of a mechanism for detecting a voltage drop in the data PTT line of the computer when a transmission is sent exclusively from a base station to the mobile unit. This actuates an audible signaling member for a predetermined time interval to indicate to a person at the mobile unit that the transmission has been sent exclusively thereto.

1 Claim, 1 Drawing Sheet

HORN HONKER INTERFACE

BACKGROUND OF THE INVENTION

The instant invention relates generally to telecommunications and more specifically it relates to an audible interface device which provides a circuit that can detect and indicate a transmission sent exclusively to a vehicle equipped with on board mobile unit (MDT) interfacing with a radio dispatch system. A Mobile Date Terminal can receive both exclusive and non-exclusive messages. An exclusive message is the one used to offer a job to the operator of one MDT. A non-exclusive message is the one used to send messages to all the MDT units in the system simultaneously. This audible system interface device detects only the exclusive messages.

There are available various conventional telecommunications which do not provide the novel improvements of the invention herein disclosed.

SUMMARY OF THE INVENTION

A primary object of the present invention is to provide an audible interface device that will overcome the shortcomings of the prior art devices.

Another object is to provide an audible interface device that will detect and announce a transmission sent exclusively to a vehicle equipped with on board computerized radio dispatch system.

An additional object is to provide an audible interface device that is activated only when it detects a voltage drop in the computer Data Push To Talk line to warn the operator of the mobile unit that a transmission is exclusively sent to the mobile unit.

A further object is to provide an audible interface device that is simple and easy to use.

A still further object is to provide an audible interface device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
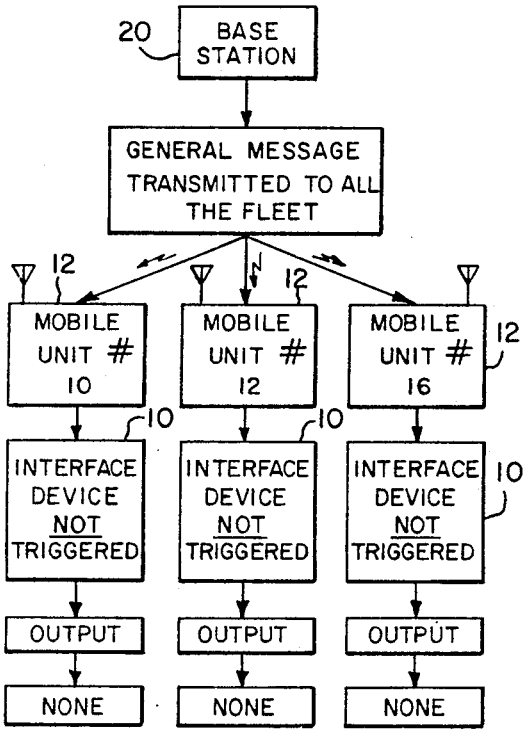
FIG. 1 is a flow chart showing a general message transmitted to all the vehicles in the fleet.
Figure 2:
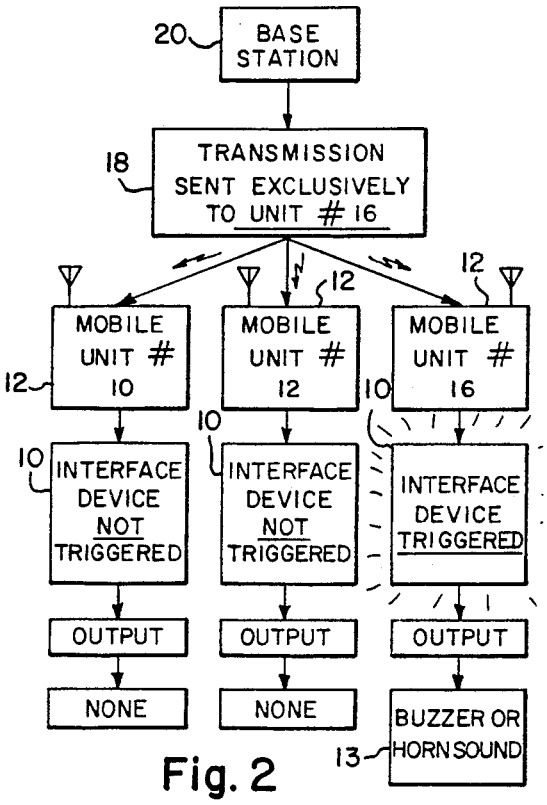
FIG. 2 is a flow chart showing a transmission sent exclusively to one mobile unit to operate the audible interface device for that mobile unit.

Turning now descriptively to the drawings, in which similar reference characters denote similar elements throughout the several views, FIGS. 1 and 2 illustrate an audible interface device 10 for each of a plurality of mobile units 12, such as motor vehicles, equipped with on board mobile units interfacing with a radio dispatch system. The device 10 consists of an audible signaling member 13. A mechanism 14 is for detecting a voltage drop in the data Push To Talk PTT line 16 of the computer when a transmission 18 is sent exclusively from a base station 20 to the mobile unit 12. This actuates the audible signaling member 13 for a predetermined time interval to indicate to a person 22 at the mobile unit 12, that the transmission 18 has been sent exclusively thereto.

Figure 3:
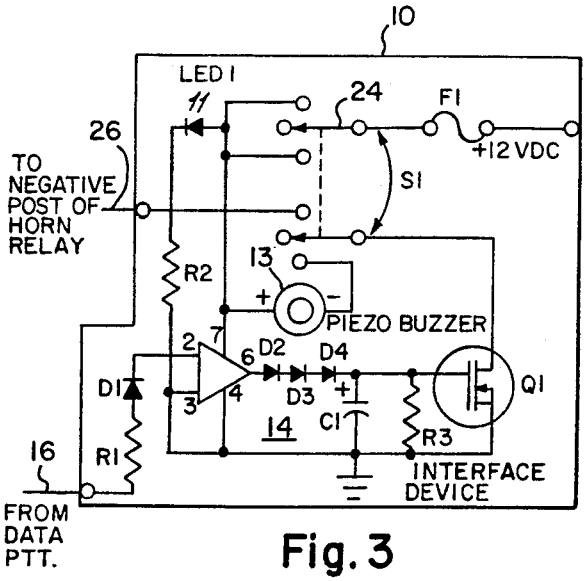
FIG. 3 is a schematic diagram of the circuitry of one typical audible interface device.

As best shown in FIG. 3, a manually operated switch 24 is electrically coupled to the detecting mechanism 14 so that in one position the switch 24 can connect the detecting mechanism 14 to the audible signaling member 13, which is a piezo buzzer, when the person 22 is directly at the mobile unit 12. In another position the switch 24 can connect the detecting mechanism 14 to the vehicles line 26 of a horn relay or other audible paging device when the person 22 is in a hearing distance away from the mobile unit 12.

Figure 4:
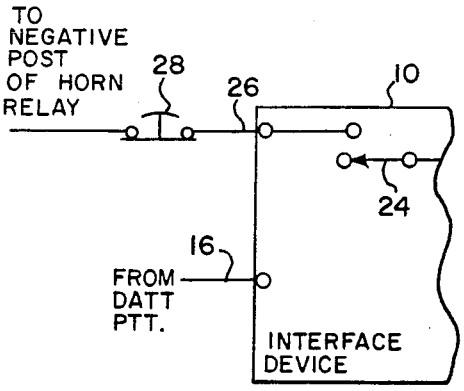
FIG. 4 is a modification showing a normally closed seat button switch connected between the negative post line of the horn relay and the audible interface device.
Figure 5:
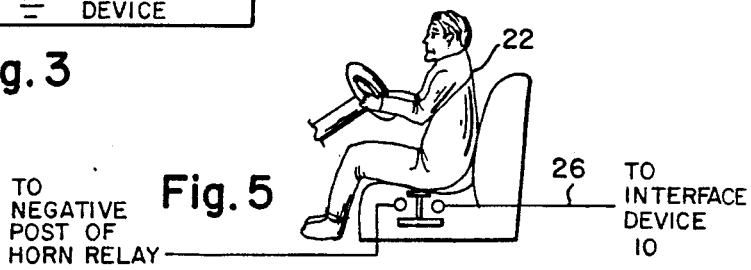
FIG. 5 is a side view of a seat within the mobile unit and showing the button switch being opened by a person sitting on the seat.

As shown in FIGS. 4 and 5, a normally closed button switch 28 is carried in the seat 30 of the mobile unit 12. The button switch 28 is electrically connected between the negative post line 26 of the horn relay and the manually operated switch 24, so that when the person 22 sits on the seat 30 the button switch 28 will open the circuit to disengage the horn relay.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An audible interface device for each of a plurality of mobile units used in a vehicle interfacing a radio dispatch base station connected to each unit by a transmission line, said device comprising:

a) audible signaling members;

b) means for detecting a voltage drop in each said line when an exclusive message is received by one of said units and actuating one of said audible signaling members for a predetermined time interval to indicate the exclusive message has been received at the unit; including a manually operated switch electrically coupled to said detecting means so that in one position said switch connects said detecting means to a first of said audible signaling members to produce a low sound level when a person operating the vehicle is sitting on a seat inside the vehicle and in another position said switch connects said detecting means to a second of said audible signaling members to produce a high sound level when the person is in hearing distance away from the vehicle, wherein the second of said audible signaling members is a vehicle horn and means are provided responsive to the person sitting on the vehicle seat to deactivate the horn.

* * * * *